US010336564B2

(12) United States Patent
Maeda et al.

(10) Patent No.: US 10,336,564 B2
(45) Date of Patent: Jul. 2, 2019

(54) MEDIUM TRANSPORTING APPARATUS AND RECORDING APPARATUS

(71) Applicant: SEIKO EPSON CORPORATION, Tokyo (JP)

(72) Inventors: Hiroyuki Maeda, Matsumoto (JP); Shota Sakagami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/868,305

(22) Filed: Jan. 11, 2018

(65) Prior Publication Data

US 2018/0215563 A1 Aug. 2, 2018

(30) Foreign Application Priority Data

Jan. 31, 2017 (JP) ..... 2017-015804

(51) Int. Cl.

| | |
|---|---|
| ***B65H 5/02*** | (2006.01) |
| ***B65H 5/00*** | (2006.01) |
| ***B65H 3/06*** | (2006.01) |
| ***B65H 3/18*** | (2006.01) |
| ***B65H 1/04*** | (2006.01) |
| ***B65H 5/22*** | (2006.01) |

(Continued)

(52) U.S. Cl.

CPC ..... *B65H 5/025* (2013.01); *B41J 11/007* (2013.01); *B65H 1/04* (2013.01); *B65H 3/06* (2013.01); *B65H 3/18* (2013.01); *B65H 5/004* (2013.01); *B65H 5/021* (2013.01); *B65H 5/224* (2013.01); *B65H 2301/44334* (2013.01); *B65H 2404/25* (2013.01); *B65H 2801/39* (2013.01); *G03G 15/6529* (2013.01)

(58) Field of Classification Search

CPC ..... B65H 5/021; B65H 5/224; B65H 5/004; B65H 2301/44334; B41J 11/007

See application file for complete search history.

(56) References Cited

U.S. PATENT DOCUMENTS

| | | | |
|---|---|---|---|
| 5,531,436 | A | 7/1996 | Ohyama et al. |
| 6,178,307 | B1 | 1/2001 | Kimura |

(Continued)

FOREIGN PATENT DOCUMENTS

| | | | |
|---|---|---|---|
| JP | 06107347 | A * | 4/1994 |
| JP | 07-137877 | A | 5/1995 |

(Continued)

*Primary Examiner* — Luis A Gonzalez

(74) *Attorney, Agent, or Firm* — Workman Nydegger

(57) ABSTRACT

A medium transporting apparatus includes an endless conveyor belt having an outer surface to which a sheet P adheres, at least two rollers, which are a first roller and a second roller, around which the conveyor belt extends. The second roller is located downstream of the first roller in a medium transporting direction. The medium transporting apparatus also includes a backing plate that supports an inner surface of the conveyor belt at a position between the first roller and the second roller. In the medium transporting apparatus, the backing plate includes a hollow-containing portion that is formed at an upstream end of the backing plate in the medium transporting direction. The hollow-containing portion has a plurality of hollows formed therein in a width direction that intersects the medium transporting direction. The plurality of hollows are formed in a support surface that supports the conveyor belt.

14 Claims, 9 Drawing Sheets

(51) Int. Cl.
*B41J 11/00* (2006.01)
*G03G 15/00* (2006.01)

(56) References Cited

U.S. PATENT DOCUMENTS

| | | | | |
|---|---|---|---|---|
| 7,434,927 | B2 | 10/2008 | Sakuma et al. | |
| 8,205,882 | B2 | 6/2012 | Kato | |
| 8,630,575 | B2 * | 1/2014 | Ideguchi | G03G 15/161 271/188 |
| 8,714,542 | B2 * | 5/2014 | Tsuji | B65H 3/46 271/105 |
| 2006/0055754 | A1 | 3/2006 | Sakuma et al. | |
| 2010/0230890 | A1 | 9/2010 | Kato | |
| 2017/0203586 | A1 * | 7/2017 | Koike | B41J 13/0009 |

FOREIGN PATENT DOCUMENTS

| | | | | |
|---|---|---|---|---|
| JP | 3432185 | B | | 5/2003 |
| JP | 2004-210530 | A | | 7/2004 |
| JP | 2005-067170 | A | | 3/2005 |
| JP | 2005-074679 | A | | 3/2005 |
| JP | 2005-112577 | A | | 4/2005 |
| JP | 2006-232462 | A | | 9/2006 |
| JP | 2010-208116 | A | | 9/2010 |
| JP | 2014172751 | A | * | 9/2014 |
| JP | 2016-183053 | A | | 10/2016 |

* cited by examiner

MEDIUM TRANSPORTING APPARATUS AND RECORDING APPARATUS

INCORPORATED BY REFERENCE

The entire disclosure of Japanese Patent Application No. 2017-015804, filed Jan. 31, 2017 is expressly incorporated by reference herein.

BACKGROUND

1. Technical Field

The present disclosure relates to a medium transporting apparatus that transports media and to a recording apparatus equipped with the medium transporting apparatus.

2. Related Art

A recording apparatus, or a printer as a typical example, may be configured to use a conveyor belt for transporting a medium, or a sheet of paper as a typical example (for example, see JP-A-2010-208116 and JP-A-2004-210530). The recording apparatus in which the conveyor belt is used to transport a medium includes a charging device for charging the conveyor belt. A medium is electrostatically adhered to the conveyor belt by attraction between electric charges on the surface of the conveyor belt and electric charges on the bottom surface of the medium, and subsequently the medium is transported to a position opposing a recording head. In particular, JP-A-2010-208116 discloses a configuration in which a static discharge device that removes electric charges from the surface of a medium transported by a conveyor belt is provided in addition to the charging device. In this configuration, a medium adheres to the conveyor belt more reliably by removing electric charges from the surface of the medium.

If a medium to be transported is left unused in a paper cassette or the like, the volume of the medium may become increased due to the medium absorbing moisture at each of its four edges (leading edge, trailing edge, left edge and right edge), which causes the medium to warp. In this case, only the four edges of the medium warp due to the increase in volume while the center portion remains flat because moisture has permeated the medium along only the four side edges.

On the other hand, the static discharge device is configured to press a static-eliminating brush or a static-eliminating roller against a medium. When the static discharge device presses, against the conveyor belt, the medium with the four edges that warp due to an increase in volume, flexure starting at the left and right side edges may gather toward the center of the medium and finally become squashed, leaving wrinkles on the medium. Known configurations in which a medium is transported by a conveyor belt do not particularly address such a problem.

SUMMARY

An advantage of some aspects of the disclosure is that a medium transporting apparatus that can avoid a problem where flexure that starts at the side edges of a transported medium gather toward the center and become squashed to leave wrinkles or that can alleviate wrinkle generation is obtained.

A medium transporting apparatus according to a first aspect of the disclosure includes an endless conveyor belt having an outer surface to which a medium adheres, at least two rollers, which are a first roller and a second roller, around which the conveyor belt extends, the second roller being located downstream of the first roller in a medium transporting direction, and a support member that supports an inner surface of the conveyor belt at a position between the first roller and the second roller. In the medium transporting apparatus, the support member includes a hollow-containing portion that is formed at an upstream end of the support member in the medium transporting direction. The hollow-containing portion has a plurality of hollows formed therein in a width direction that intersects the medium transporting direction. The plurality of hollows are formed in a support surface that supports the conveyor belt.

According to this configuration, the support member includes the hollow-containing portion that is formed at an upstream end of the support member in the medium transporting direction, and the hollow-containing portion has a plurality of hollows formed therein in a width direction that intersects the medium transporting direction. The hollows are formed in a support surface that supports the conveyor belt. Thereby, undulations of which the wave direction corresponds to the width direction can be formed at least on a portion of the medium adhering surface of the conveyor belt. When a medium adheres to the conveyor belt having the undulations, the medium is stretched in the width direction. This can reduce propagation of flexure from the side edges of the medium toward the center in the medium width direction. Accordingly, this eliminates or reduces generation of wrinkles that is caused by the flexure of the medium at the sides gathering toward the center.

In the medium transporting apparatus, it is preferable that the support surface of the support member be located outside a tangent that is one of two tangents common to the first roller and the second roller and is closer to the support surface. It is also preferable that the support member be configured to apply tension to the conveyor belt.

With this configuration, the support member firmly supports the conveyor belt so as to achieve stable transport of a medium.

It is preferable that in the medium transporting apparatus, each of the hollows be formed so as to taper from an upstream end to a downstream end in the medium transporting direction. With this configuration, the conveyor belt can move smoothly on the support member.

It is preferable that in the medium transporting apparatus, the hollow-containing portion be formed such that the hollows and support portions that support the conveyor belt are disposed alternately in the width direction.

With this configuration, the conveyor belt is caused to undulate on the region where the hollow-containing portion is formed in the support member. Moreover, the conveyor belt can be stably supported.

In the medium transporting apparatus, it is preferable that the hollow-containing portion include protection portions disposed at least at respective upstream ends of the support portions in the medium transporting direction, and that the protection portions protect the conveyor belt that comes into contact with the support portions.

The conveyor belt that moves over the hollow-containing portion is susceptible to scratches and wear due to grade differences in the widthwise vicinity of each support portion in the hollow-containing portion. According to this configuration, the hollow-containing portion includes protection portions disposed at least at respective upstream ends of the support portions in the medium transporting direction. Thus, the protection portions protect the conveyor belt and can reduce scratches and wear of the conveyor belt that is in a sliding contact with the support portions.

It is preferable that in the medium transporting apparatus, the support portions be connected to each other in the width direction at the upstream ends of the support portions in the medium transporting direction.

According to this configuration, a plurality of the support portions are connected to each other in the width direction at the upstream ends of the support portions in the medium transporting direction. Thus, the accuracy of positioning of each of the support portions can be improved.

It is preferable that in the medium transporting apparatus, the hollow-containing portion include a first region that includes a narrow hollow being narrow in the width direction and a second region that includes a wide hollow being wider than the narrow hollow, and that in the hollow-containing portion, the first region be provided at a center in the width direction and the second region be provided at a position closer than the first region to an end in the width direction.

With this configuration, generation of wrinkles in the medium that adheres to the conveyor belt can be effectively suppressed.

It is preferable that the medium transporting apparatus further include a static-eliminating unit that eliminates electric charges from a surface of a medium that is transported by the conveyor belt.

According to this configuration, the static-eliminating unit eliminates electric charges from the surface of the medium that is transported by the conveyor belt. This enables the medium to adhere to the conveyor belt.

It is preferable that in the medium transporting apparatus, the static-eliminating unit be disposed at a position opposing the hollow-containing portion.

With this configuration, the medium can adhere to the conveyor belt by removing electric charges from the surface of the medium while generation of wrinkles in the medium is eliminated or reduced.

It is preferable that the medium transporting apparatus further include a charging device that is disposed at a position upstream of the static-eliminating unit in a belt rotation direction of the conveyor belt and charges the conveyor belt. With this configuration, the medium can adhere to the conveyor belt more effectively.

It is preferable that in the medium transporting apparatus, the conveyor belt be configured such that when the conveyor belt is supported, in the medium transporting direction, by a region of the support member where the hollow-containing portion is disposed, apparent belt width decreases.

When the conveyor belt is supported by a region of the support member where the hollow-containing portion is disposed, the undulations are formed, and apparent belt width is thereby caused to decrease. With this configuration, similar operational advantages as described above can be obtained.

In the medium transporting apparatus, it is preferable that the conveyor belt be configured such that when the conveyor belt is supported, in the medium transporting direction, by a region of the support member where the hollow-containing portion is disposed, apparent belt width decreases, and that the static-eliminating unit eliminate electric charges from a medium transported by the conveyor belt at a position where the belt width is narrowest.

When the conveyor belt is supported by a region of the support member where the hollow-containing portion is disposed, apparent belt width decreases. The apparent belt width returns to the original width after the conveyor belt passes the region. If the static-eliminating unit causes the medium to adhere to the conveyor belt before the belt width becomes narrowest, wrinkles may gather in the medium when the belt width becomes narrower after adhering. According to this configuration, the static-eliminating unit eliminates electric charges from the medium transported by the conveyor belt at a position where the belt width becomes narrowest. This can eliminate the likelihood of wrinkle generation caused by the belt width becoming narrower.

A recording apparatus according to a second aspect of the disclosure includes a recording head that performs recording onto a medium and the medium transporting apparatus according to the first aspect, wherein the conveyor belt supported by the support member opposes the recording head and the hollow-containing portion is provided upstream of a recording region where the recording head performs recording.

With this configuration, any one of the operational advantages described above can be obtained in the recording apparatus.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Example 1

Figure 1:
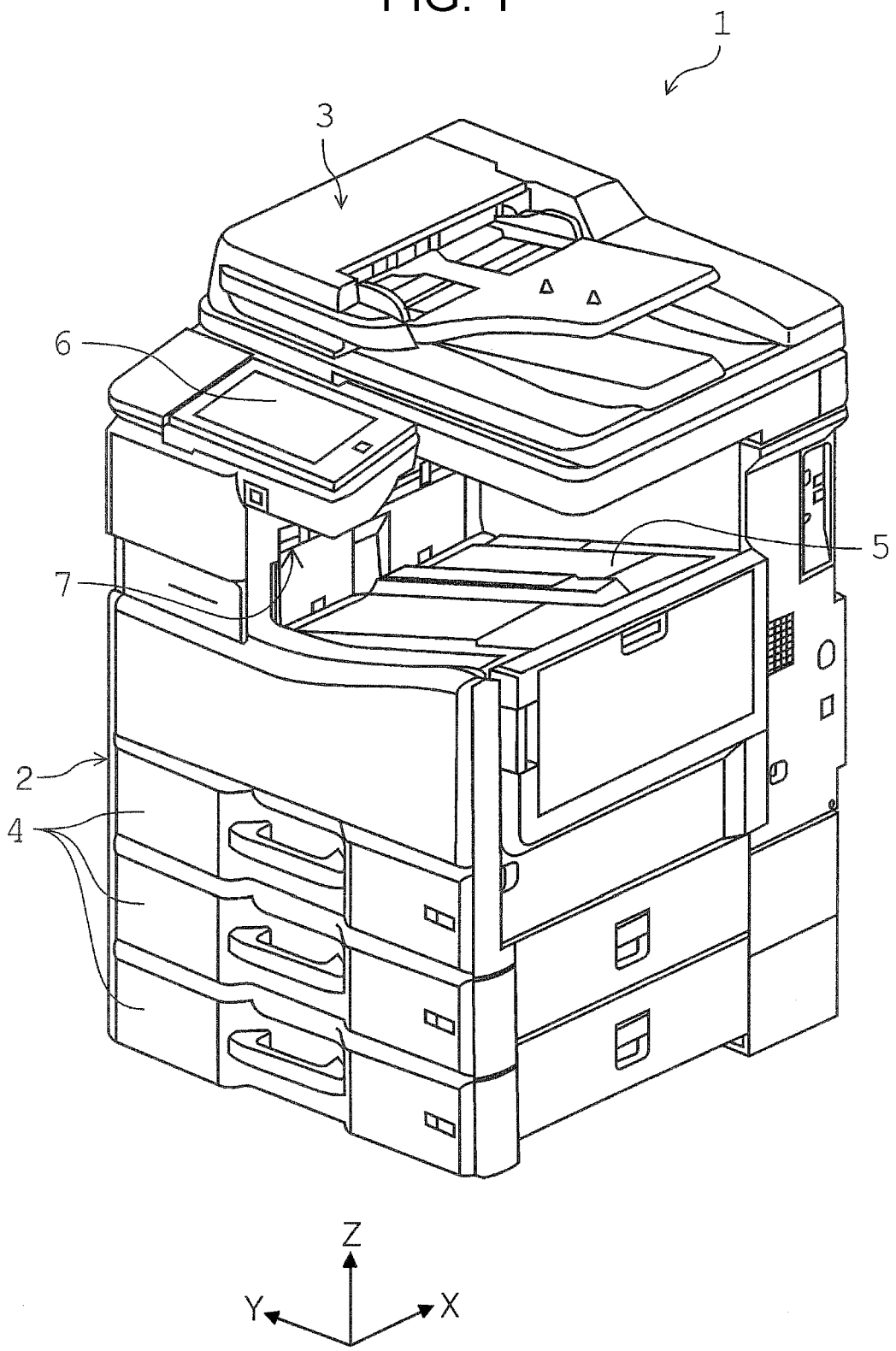
FIG. 1 is a perspective view illustrating the exterior of a printer according to one example of the disclosure.
Figure 2:
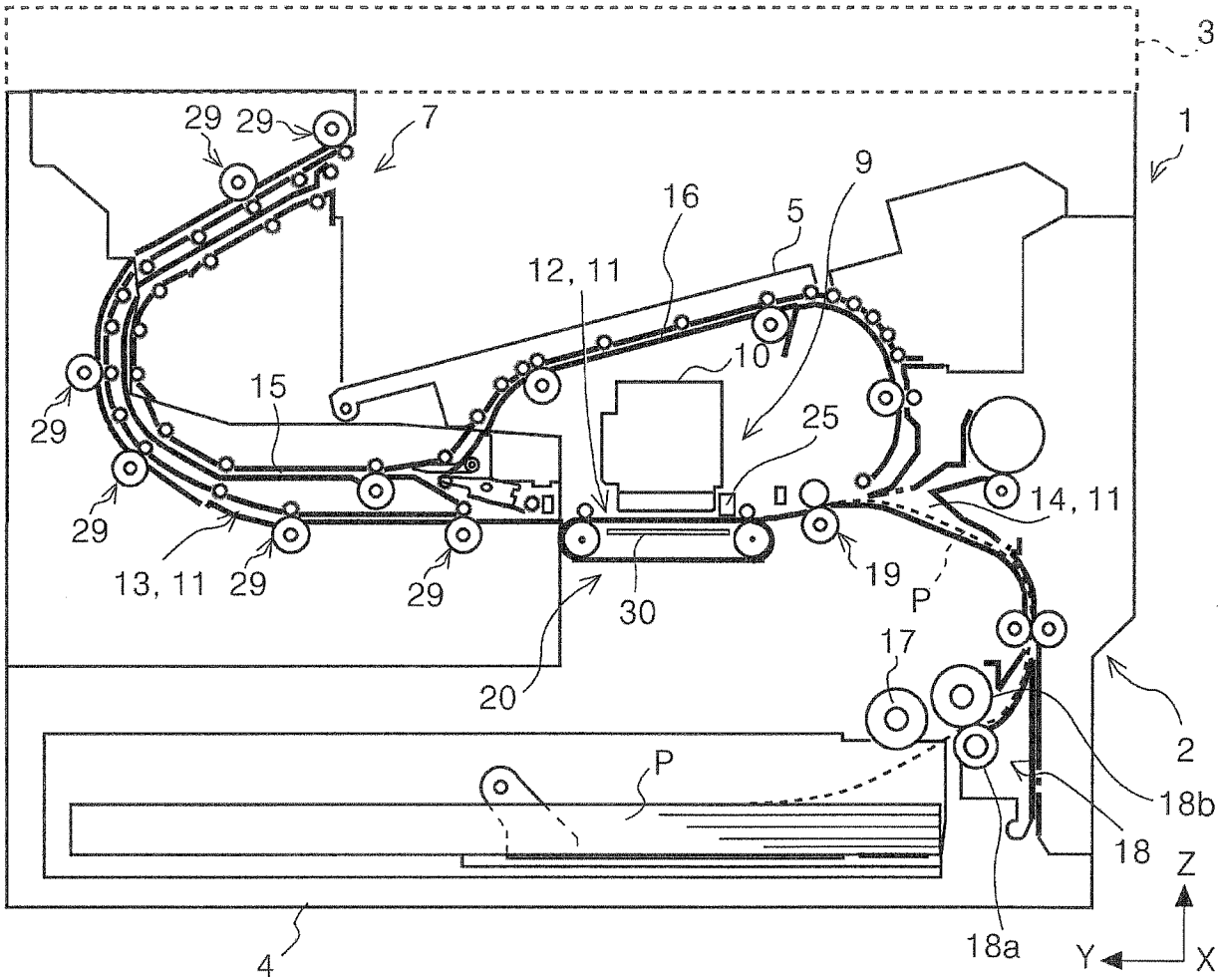
FIG. 2 is a view schematically illustrating a transport path in the printer for sheets of paper.
Figure 3:
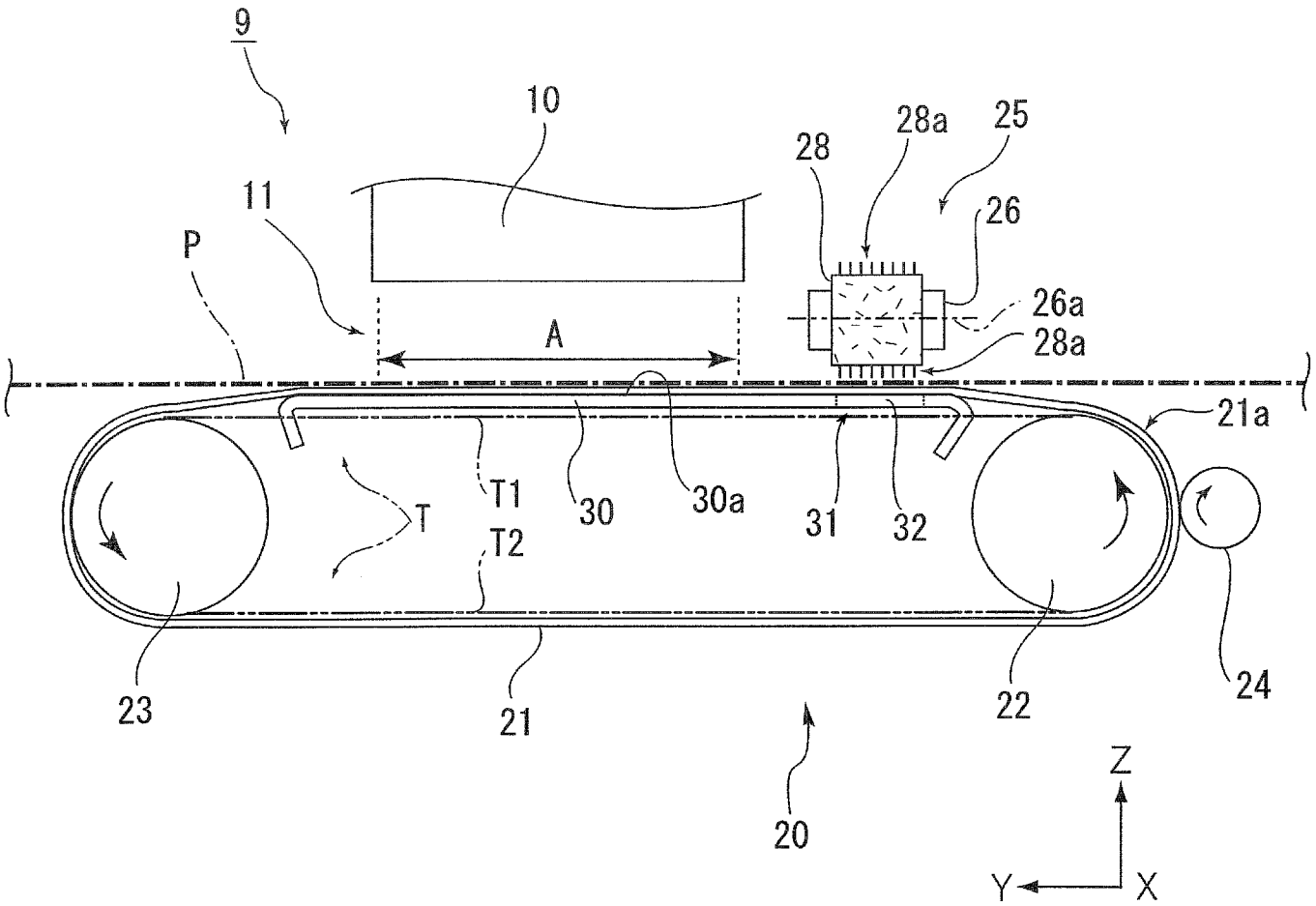
FIG. 3 is a side view schematically illustrating a medium transporting apparatus.
Figure 4:
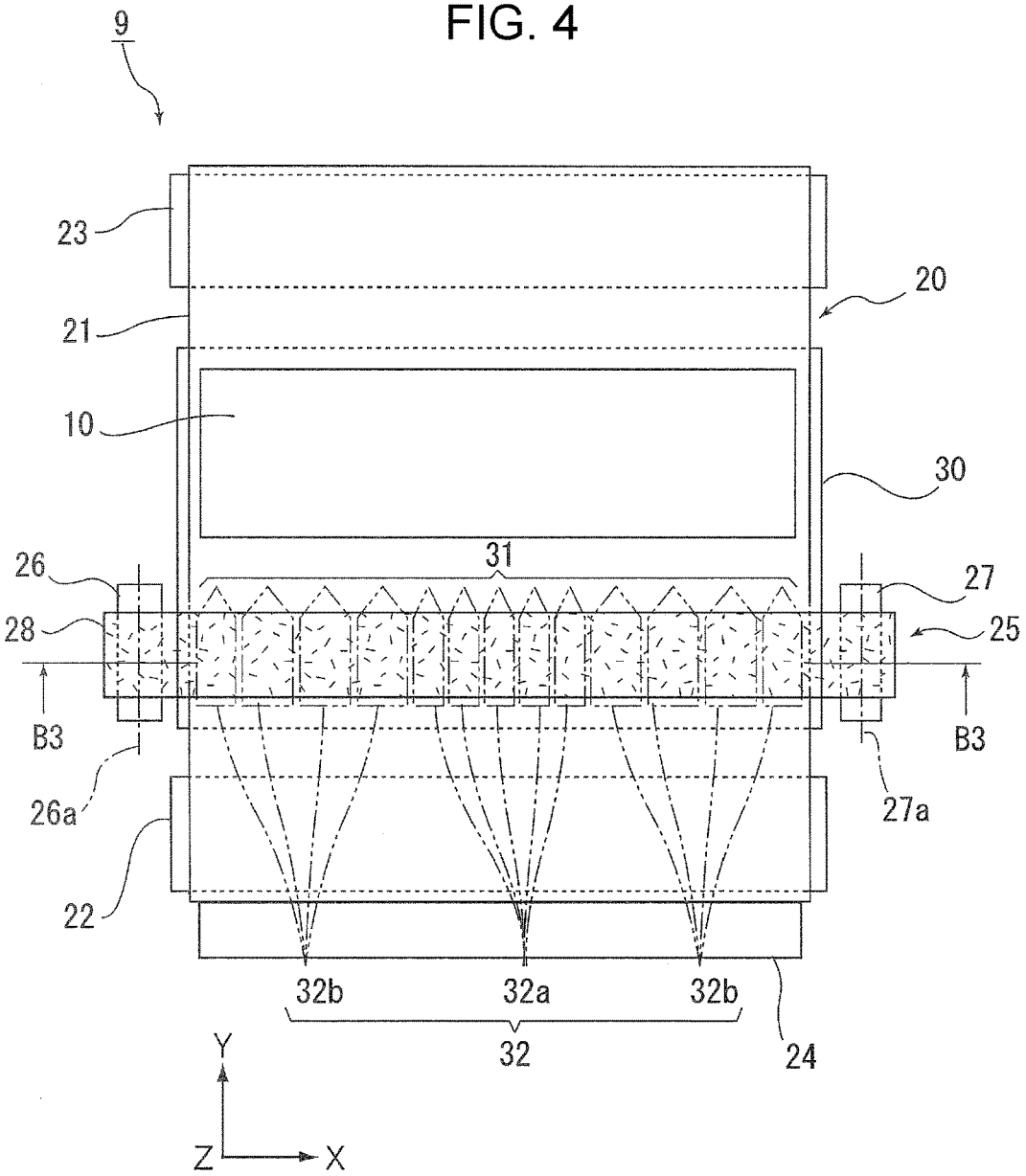
FIG. 4 is a plan view schematically illustrating the medium transporting apparatus.
Figure 5:
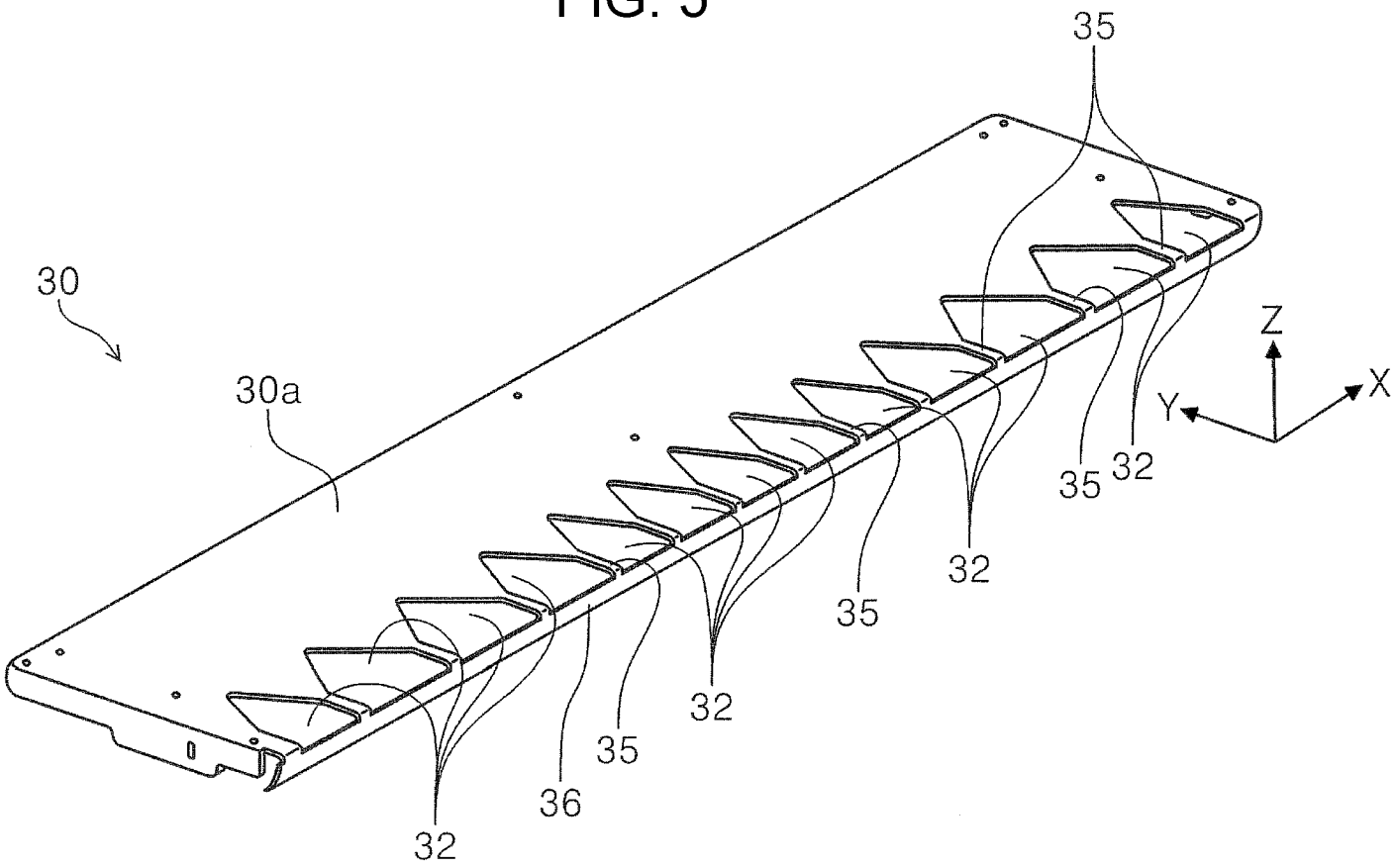
FIG. 5 is a perspective view illustrating a backing plate.
Figure 6:
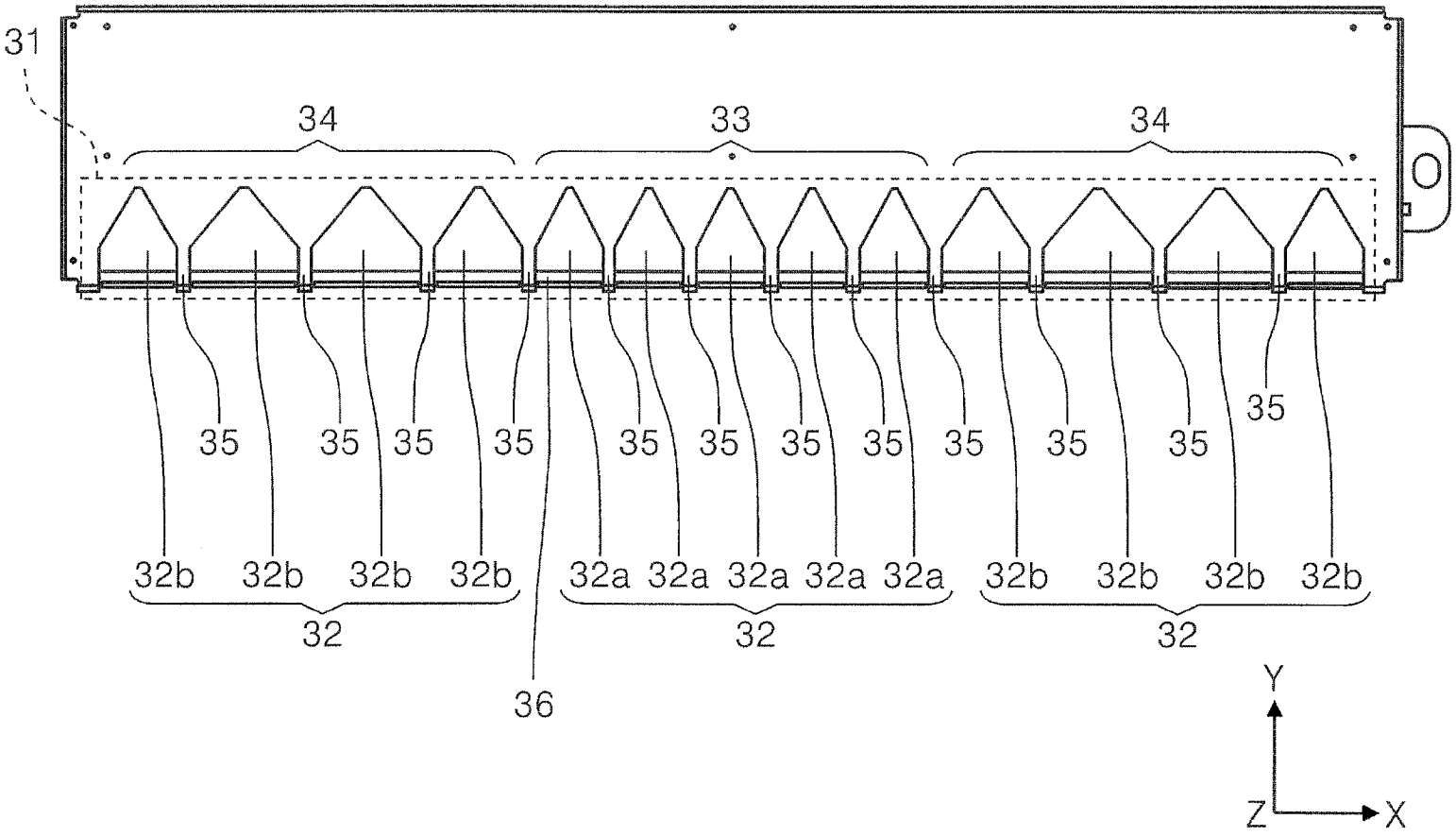
FIG. 6 is a plan view illustrating the backing plate.
Figure 7:
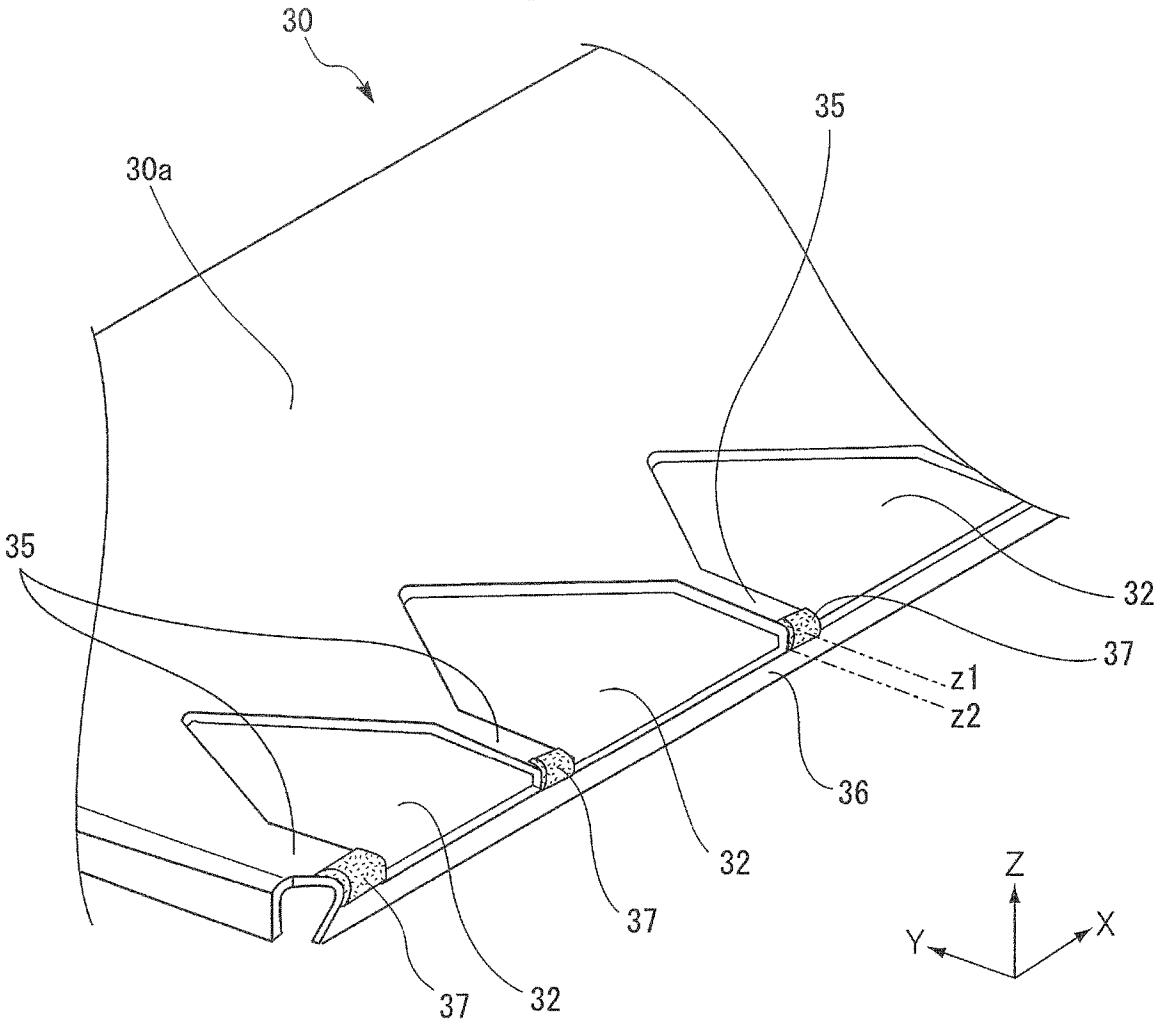
FIG. 7 is an enlarged perspective view illustrating part of the backing plate.
Figure 8:
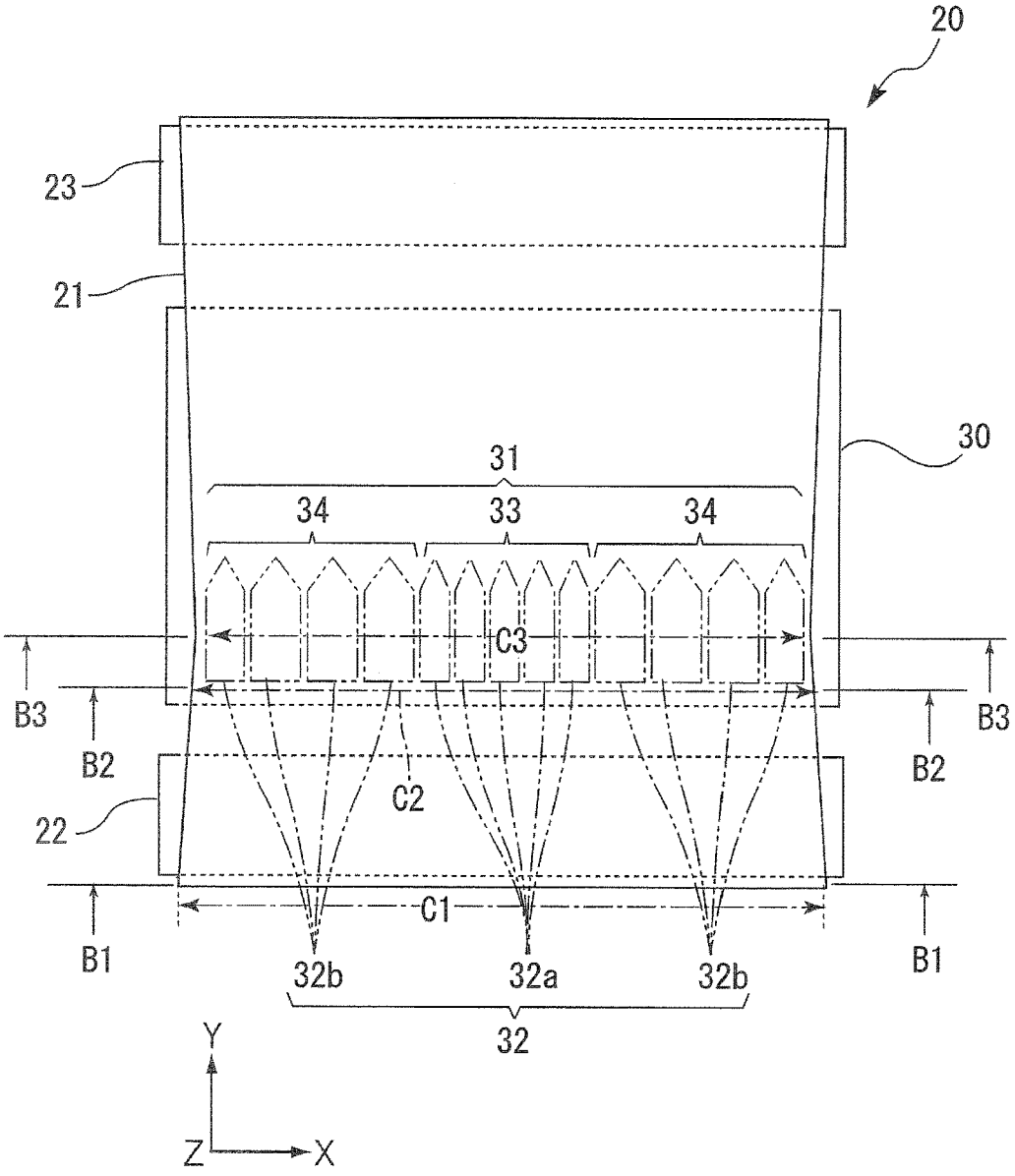
FIG. 8 is a plan view illustrating a belt conveyor device.
Figure 9:
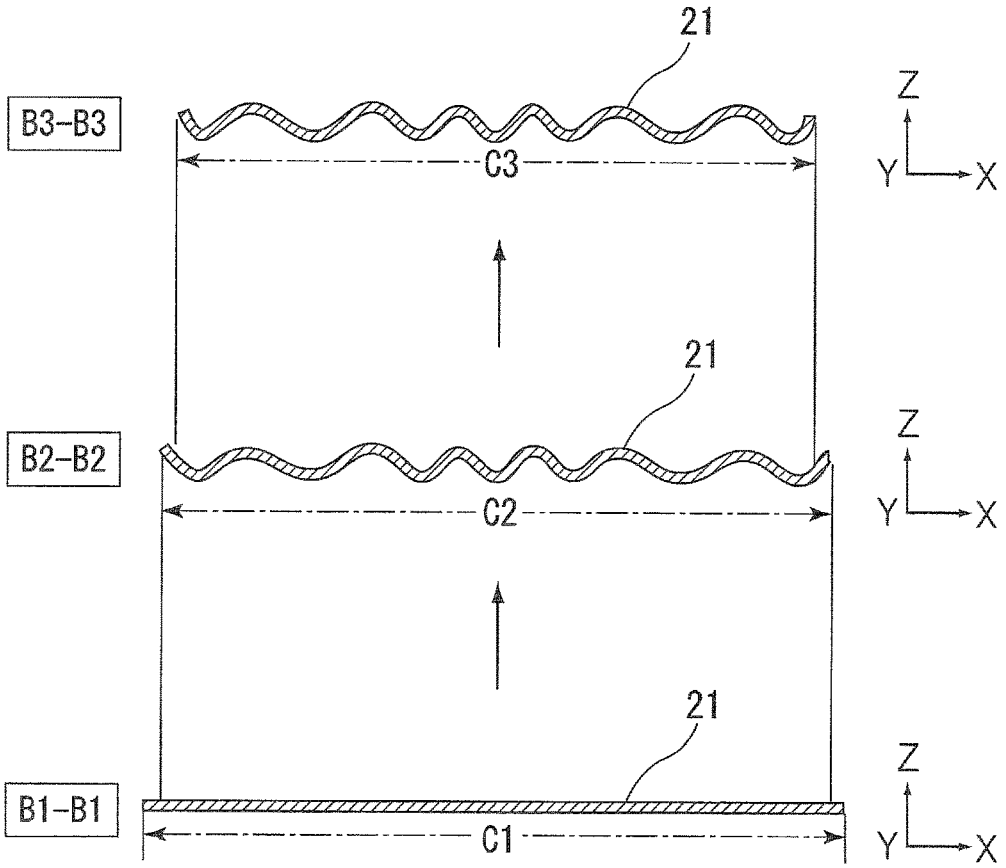
FIG. 9 is a view illustrating changes in the width of a conveyor belt, which includes cross sections taken along line B1-B1, line B2-B2, and line B3-B3 in FIG. 8 and viewed in the direction of respective arrows.

First, a recording apparatus according to an example of the disclosure will be outlined. An example of the recording apparatus according to the Example 1 is an ink jet printer 1 (also referred to simply as a "printer 1" below). FIG. 1 is a perspective view illustrating the exterior of the printer 1 according to one example of the disclosure. FIG. 2 is a view schematically illustrating a transport path in the printer 1 for sheets of paper. FIG. 3 is a side view schematically illustrating a medium transporting apparatus. FIG. 4 is a plan view schematically illustrating the medium transporting apparatus. FIG. 5 is a perspective view illustrating a backing plate. FIG. 6 is a plan view illustrating the backing plate. FIG. 7 is an enlarged perspective view illustrating part of the backing plate. FIG. 8 is a plan view illustrating a belt conveyor device. FIG. 9 is a view illustrating changes in the width of a conveyor belt, which includes cross sections taken along line B1-B1, line B2-B2, and line B3-B3 in FIG. 8 and viewed in the direction of respective arrows.

In the X-Y-Z coordinate system shown in each drawing, the X direction represents the width direction of a medium transported along a transport path of the recording apparatus, the Y direction represents the transport direction of the medium, and the Z direction represents the height direction of the apparatus. In each drawing, the −X direction is the direction from the rear side to the front side of the apparatus, and the +X direction is the opposite direction.

Overview of Printer

The printer 1 will be described with reference to FIG. 1. The printer 1 is formed as a multifunction printer including an apparatus body 2 and a scanner unit 3. The apparatus body 2 includes a plurality of paper cassettes 4 that accommodate sheets of paper P (see FIG. 2), which are also referred to as "media". Each of the paper cassettes 4 is detachably mounted into the apparatus body 2 from the front side thereof (from the side in the −X direction in FIG. 1). In this specification, sheets of paper P (sheets P) includes, for example, sheets of plain paper, thick paper, or photo paper.

In the height direction (Z direction) of the apparatus body 2, a discharging portion 7 and a media placement portion 5 are provided between the scanner unit 3 and the paper cassette 4. Sheets P on which a line head 10 (FIG. 2), which will be described below, has performed recording are discharged from the discharging portion 7 and placed on the media placement portion 5. An operation unit 6 is disposed close to the front side of the apparatus body 2. The operation unit 6 includes a display unit, such as a liquid crystal panel. Instructions for recording and image scanning can be input to the printer 1 through the operation unit 6.

Transport Path of Printer

Next, a transport path for sheets P in the printer 1 will be described with reference to FIG. 2. The printer 1 according to Example 1 includes a transport path 11 for sheets P. The transport path 11 includes a feed path 14, a straight path 12, and a face-down discharge path 13. A sheet P is picked up from a paper cassette 4 and fed through the feed path 14. The feed path 14 is connected to the straight path 12, which includes a recording region where the line head 10, which is also referred to as a "recording head" that performs recording onto a medium. A sheet P is sent from the straight path 12 to the discharging portion 7 through the face-down discharge path 13. Next, transport of sheets P from the paper cassettes 4 to the discharging portion 7 will be described.

Note that the printer 1 also includes a switch-back path 15 and an inversion path 16. The switch-back path 15 branches from the straight path 12 at a position downstream of the line head 10. The inversion path 16, which is connected to the switch-back path 15, inverts the top and bottom (first face and second face) of a sheet P and returns the inverted sheet P to the straight path 12. Thus, the printer 1 is formed so as to be able to perform recording onto the first face of a sheet P and consecutively onto the second face, in other words, to be able to perform double-sided recording. Further description on the inversion of a sheet P by using the switch-back path 15 and the inversion path 16 is omitted here.

A feed roller 17 and a separation roller pair 18 that separates one sheet from plural sheets of paper are provided in this order along the feed path 14 in the transport direction of sheets P. The feed roller 17 is rotationally driven by a drive source (not shown). The separation roller pair 18, referred to as "retard rollers", includes a drive roller 18*a* and an idler roller 18*b*. The drive roller 18*a* sends a sheet P toward the straight path 12, which will be described below. The idler roller 18*b* separates a sheet P from others by nipping the sheet P in collaboration with the drive roller 18*a*.

As illustrated in FIG. 2, a plurality of sheets P accommodated in the paper cassettes 4 are picked up by the feed roller 17 one by one starting from the topmost sheet P, and the sheet P is transported downstream in the transport direction. At this time, there may be a case in which the topmost sheet P and subsequent sheets P are transported simultaneously. In this case, the separation roller pair 18 separates the topmost sheet P from the subsequent sheets P so that only the topmost sheet P is sent to the feed path 14.

A resist roller 19 is disposed downstream of the separation roller pair 18 in the transport direction. In Example 1, the feed path 14 is connected to the straight path 12 at the position of the resist roller 19. The straight path 12 is a path that extends straight. The resist roller 19, a belt conveyor device 20, a static-eliminating unit 25, and the line head 10 are disposed in this order along the straight path 12 in the transport direction. The straight path 12 is a path that passes the recording region of the line head 10 and extends both upstream and downstream of the line head 10.

In the present embodiment, the belt conveyor device 20, which constitutes a medium transporting apparatus 9 that transports sheets P, is disposed in a region opposing the head surface of the line head 10. The belt conveyor device 20 supports the bottom side of a sheet P, which is opposite to the recording side of the sheet P. The structure of the medium transporting apparatus 9, including the belt conveyor device 20, will be described in detail below.

The line head 10 is formed so as to perform recording by ejecting ink onto the recording side of a sheet P when the sheet P is transported to a position on the belt conveyor device 20 that opposes the line head 10. The line head 10 is a recording head in which the ink ejecting nozzles are provided so as to cover the whole width of a sheet P, and the recording head is formed so as to be able to perform recording over the whole width of the sheet P without moving in the medium width direction. Note that although the printer 1 according to Example 1 includes the line head 10, the printer 1 may instead include a serial-type recording head that is mounted on a carriage and performs recording by ejecting liquid onto a medium while moving reciprocally in a direction intersecting the medium transporting direction.

A sheet P transported along the straight path 12 is subsequently sent to the face-down discharge path 13. The face-down discharge path 13 is a transport path 11 having a curved portion to which the straight path 12 is connected. The sheet P, on which the line head 10 has performed recording, is sent along the face-down discharge path 13 so that the sheet P is discharged from the discharging portion 7 with the recording side facing downward. The sheet P entering the face-down discharge path 13 is transported by a plurality of advancing roller pairs 29, discharged from the discharging portion 7, and placed on the media placement portion 5 with the recording side facing down.

Medium Transporting Apparatus

Next, the medium transporting apparatus 9 that transports sheets P will be described. The medium transporting apparatus 9 according to the embodiment (see FIGS. 3 and 4) includes the belt conveyor device 20. The belt conveyor device 20 includes an endless conveyor belt 21, which causes a sheet P to adhere to the outer surface thereof, and at least two rollers, in other words, a first roller 22 and a second roller 23, around which the conveyor belt 21 extends. The second roller 23 is located downstream of the first roller 22 in the medium transporting direction (i.e., the +Y direction in FIG. 2). In the belt conveyor device 20, the first roller 22 is rotationally driven by a drive source (not shown). The first roller 22 subsequently drives the conveyor belt 21 so as to transport a sheet P downstream in the medium transporting direction. The second roller 23 is passively rotated by the conveyor belt 21 that is driven by the rotation of the first roller 22.

In the embodiment, the conveyor belt 21 is a belt that electrostatically adheres a sheet P to the outer surface 21*a* thereof such that the sheet P may be transported. The medium transporting apparatus 9 has a charging roller 24, which is an example of a charging device that charges the conveyor belt 21, and a static-eliminating unit 25, which eliminates electric charges from the surface of the sheet P transported by the conveyor belt 21.

In addition, the belt conveyor device 20 includes a backing plate 30 between the first roller 22 and the second roller 23. The backing plate 30 is a support member that supports at least part of the inner surface of the conveyor belt 21. The backing plate 30 is a characterizing portion of the disclosure. In the following, configurations of the charging roller 24 and the static-eliminating unit 25 will be described first, followed by description of the backing plate 30, a characterizing portion of the disclosure.

Charging Roller

As illustrated in FIG. 3, the charging roller 24 is disposed upstream of the static-eliminating unit 25 in the belt rotation direction of the conveyor belt 21. In addition, the charging roller 24 is disposed at a level below the transport path 11 and at a position opposing the first roller 22. The charging roller 24 is in contact with the outer surface 21*a* of the conveyor belt 21. When rotation of the first roller 22 and the second roller 23 drives the conveyor belt 21, the charged outer surface 21*a* of the conveyor belt 21 becomes a path forming surface that constitutes the transport path 11 after the charging roller 24 comes into contact with the outer surface 21*a*. This configuration improves adherence of a sheet P to the conveyor belt 21, which constitutes the transport path 11, such that the sheet P can adhere to the conveyor belt 21 more effectively.

First Static-Eliminating Unit

In the medium transporting apparatus 9, the static-eliminating unit 25 is disposed between the line head 10 and the first roller 22 in the medium transporting direction. The static-eliminating unit 25 removes electric charges from a surface of a sheet P that is transported by the conveyor belt 21. As illustrated in FIG. 4, the static-eliminating unit 25 includes a drive roller 26 (also see FIG. 3), which is rotationally driven by a drive source (not shown), and an idler roller 27. The drive roller 26 and the idler roller 27 are disposed such that the conveyor belt 21 is located therebetween in the width direction of sheet P (X direction). Note that respective rotation axes 26*a* and 27*a* of the drive roller 26 and idler roller 27 are oriented parallel to the medium transporting direction. An endless static-eliminating belt 28 having an outward-projecting brush 28*a* (FIG. 3) extends around the drive roller 26 and the idler roller 27 (FIG. 4). The static-eliminating belt 28 is disposed such that the brush 28*a* is in contact with the conveyor belt 21 across the whole width of the conveyor belt 21.

When the drive roller 26 is rotated, a portion of the static-eliminating belt 28 that opposes a sheet P on the conveyor belt 21 moves in the X direction, which is the medium width direction. In other words, another portion of the brush 28*a* of the static-eliminating belt 28 is brought into contact with the sheet P that electrostatically adheres to the conveyor belt 21. At this time, the brush 28*a* of the static-eliminating belt 28 is pressed against the sheet P, and electric charges on the surface of the sheet P are thereby removed. Removing electric charges from the surface of the sheet P improves adherence of the sheet P to the conveyor belt 21. Note that the brush 28*a* can be formed of a metal material, such as stainless steel, or a resin material. Also note that the static-eliminating unit 25 is not limited to a configuration of using the static-eliminating belt 28, which is an endless belt having the brush 28*a*. The static-eliminating unit 25 may be formed by using a static-eliminating roller.

Backing Plate

Next, a configuration of the backing plate 30 will be described with reference to FIGS. 3 to 9. The backing plate 30 includes a support surface 30*a* that extends in the medium transporting direction and supports the conveyor belt 21 and a hollow-containing portion 31 in which a plurality of hollows 32 that are formed in the support surface 30*a* are formed in the width direction (X direction) that intersects the medium transporting direction. The hollows 32 are hollow portions of the support surface 30*a* of the backing plate 30. In the embodiment, the hollows 32 are formed as through holes. Alternatively, the hollows 32 can be formed as recesses or grooves.

In the backing plate 30, as illustrated in FIG. 3, the support surface 30*a* is positioned outside a tangent T1 that is one of the two tangents T (i.e., T1 and T2 indicated by dash-dot-dot lines in FIG. 3) common to the first roller 22 and the second roller 23 and is closer to the support surface 30*a*. Thus, the backing plate 30 is formed so as to apply tension to the conveyor belt 21. With this configuration, the backing plate 30 firmly supports the conveyor belt 21 so as to achieve stable transport of sheets P.

The hollow-containing portion 31, which is disposed on the support surface 30*a* of the backing plate 30, is, in other words, a portion in which irregularities are formed on the support surface 30*a* in the width direction. This causes the medium adhering surface (outer surface 21*a*) of the conveyor belt 21 to undulate in such a manner that the wave direction of the undulations (see cross sections B2-B2 and B3-B3 in FIG. 9) corresponds to the width direction (X direction), since the conveyor belt 21 is supported by the support surface 30*a* having the hollow-containing portion 31. In the case that the conveyor belt 21 undulates, for example, a sheet P with four side edges that become flexed due to an increase in volume is stretched across the undulations in the width direction when the sheet P adheres to the conveyor belt 21. This can reduce propagation of flexure at the side edges toward the center of the sheet P in the medium width direction. Consequently, this eliminates or reduces generation of wrinkles resulting from the flexure of the sheet P at the sides in the width direction that are gathered toward the center.

In the embodiment, each of the hollows 32 is formed so as to taper from the upstream side to the downstream side (+Y direction) in the medium transporting direction (see FIGS. 5 and 6). In other words, each hollow 32 tapers toward the downstream side in the belt rotation direction of the conveyor belt 21 (i.e., in the counterclockwise direction in FIG. 3). The conveyor belt 21 can thereby move smoothly along the support surface 30*a* of the backing plate 30. Note that although, in the embodiment, each hollow 32 starts to taper from a mid-portion thereof in the medium transporting direction, the entire hollow 32 may be formed, for example, so as to taper, in other words, the entire hollow 32 may be shaped like a triangle with its apex located downstream. Alternatively, the downstream side of the hollow 32 may be shaped like a circular arc or an elliptical arc.

As illustrated in FIGS. 5 and 6, the hollow-containing portion 31 is formed such that the hollows 32 and support portions 35 that support the conveyor belt 21 are disposed alternately in the width direction (X direction). By providing a support portion 35 between every pair of adjacent hollows 32, the conveyor belt 21 is caused to undulate in the region where the hollow-containing portion 31 is formed in the backing plate 30. In addition, support portions 35 can stably support the conveyor belt 21.

A plurality of support portions 35 are connected to each other in the width direction by a link portion 36 (FIGS. 5 and 6) at the upstream ends of the support portions 35 in the medium transporting direction (the ends in the −Y direction). Since the upstream ends of the support portions 35 in the medium transporting direction are not free ends but are connected by the link portion 36 in the width direction, the accuracy of positioning of each support portion 35 can be improved. In addition, the overall strength of the support portions 35 can be improved. Note that as illustrated in FIG. 7, the support portions 35 are formed so as to be flush with the support surface 30*a* at a level z1. The support portions 35 are connected to each other by the link portion 36 at a level z2, which is lower than the level z1 of the support surface 30*a*. In other words, the support portions 35 are connected to each other at a position distant from the conveyor belt 21 so as not to interfere with the conveyor belt 21. This can eliminate the likelihood of the link portion 36 loading the conveyor belt 21 due to contact with the conveyor belt 21.

The hollow-containing portion 31 has protection portions 37 (FIG. 7) at least at respective upstream ends of the support portions 35 in the medium transporting direction (−Y direction). The protection portions 37 are provided for protecting the conveyor belt 21 that comes into contact with the support portions 35. In the embodiment, the backing plate 30 is formed, for example, of a metal plate or a resin plate, such as a plastic plate, and the protection portions 37 are made of a material, such as a resin, that is less rigid than the backing plate 30.

The conveyor belt 21 that moves over the hollow-containing portion 31 is susceptible to scratches and wear due to grade differences (hollows 32) in the widthwise vicinity of each support portion 35 in the hollow-containing portion 31. However, the protection portions 37 can control the occurrence of scratches and wear on the conveyor belt 21 that is in sliding contact with the support portions 35. Note that the thickness of the protection portions 37 in FIG. 7 is exaggerated to make these portions more recognizable. However, it is preferable that each of the protection portions 37 be provided as a coating without any recognizable difference in level between the protection portion 37 and the support portion 35. As an alternative example of the protection portion 37, a small roller that can passively rotate while in contact with the moving conveyor belt 21 may be disposed at the upstream end of the support portion 35.

Hollows 32 having different widths in the width direction are provided in the hollow-containing portion 31 according to the embodiment. More particularly, as illustrated in FIG. 6, the hollow-containing portion 31 is formed so as to include a first region 33, in which narrow hollows 32*a* having a smaller width are provided, and second regions 34, in which wide hollows 32*b* having a width larger than the narrow hollows 32*a* are provided. The first region 33 is disposed at the center of the hollow-containing portion 31 in the width direction, and the second regions 34 are provided closer than the first region 33 to the ends of the hollow-containing portion 31 in the width direction (X direction). In other words, the second regions 34 are provided on both sides with respect to the first region 33, which is provided at the center in the width direction.

As described previously, a sheet P that is left unused in a paper cassette 4 may warp at four side edges due to an increase in volume while the center portion remains flat. Arranging the narrow hollows 32*a* and the wide hollows 32*b* in such a manner as above forms narrow-width undulations (for example, see cross section B3-B3 in FIG. 9) in a region of the conveyor belt 21 to which the flat central portion of the sheet P adheres. With this configuration, the backing plate 30 can suppress generation of wrinkles in the central portion of the sheet P more effectively.

Arrangement of Backing Plate and Static-Eliminating Unit in Printer

Next, arrangement of the backing plate 30 and the static-eliminating unit 25 in the printer 1 will be described. As illustrated in FIG. 3, the backing plate 30 is provided such that the conveyor belt 21 supported by the backing plate 30 opposes the line head 10 and the hollow-containing portion 31 is positioned upstream of a recording region A (FIG. 3) where the line head 10 performs recording.

The static-eliminating unit 25 is disposed at a position opposing the hollow-containing portion 31 of the backing plate 30. As a result, a sheet P can adhere to the conveyor belt 21 by removing electric charges from the surface of the sheet P while generation of wrinkles in the sheet P adhering to the conveyor belt 21 is eliminated or reduced by the hollow-containing portion 31. This enables the sheet P adhering uniformly to the conveyor belt 21 to be fed to the recording region A where the line head 10 is present, thereby enabling accurate recording.

When the conveyor belt 21 is supported by the region of the backing plate 30 where the hollow-containing portion 31 is provided, the undulations of the conveyor belt 21 are formed in the width direction as described above. Forming the undulations generates a portion of the conveyor belt 21 where the apparent belt width of the conveyor belt 21 decreases as illustrated in FIGS. 8 and 9. More specifically, when the belt conveyor device 20 is viewed in plan view as illustrated in FIG. 8, the width of the conveyor belt 21 is equal to the original belt width C1 (also see cross section B1-B1 in FIG. 9), for example, at the end of the belt conveyor device 20 in the Y direction (at line B1-B1 in FIG. 8), whereas the belt width becomes C3 (also see cross section B3-B3 in FIG. 9), which is the maximum apparent belt width, at line B3-B3 (FIG. 8) that is located near the center of each hollow 32 in the Y direction. Note that line B3-B3 at which the belt width becomes maximum may shift forward or backward from the center of each hollow 32 in the Y direction, depending on the shape of the hollow 32.

The static-eliminating unit 25 is formed so as to eliminate electric charges from the sheet P transported on the conveyor belt 21 at the position where the belt width becomes minimum (at line B3-B3). In other words, the static-eliminating unit 25 is provided so as to oppose line B3-B3 (FIG. 4).

Suppose that the static-eliminating unit 25 causes a sheet P to adhere to the conveyor belt by eliminating electric charges from the sheet P (for example, at line B2-B2 in FIG. 8 where the belt width is C2) before the belt width becomes narrowest (belt width C3 in FIG. 9). In this case, the sheet P adheres at line B2-B2, and subsequently the belt width becomes narrower to C3, which may cause generation of wrinkles on the sheet P. However, this problem can be avoided if electric charges on the sheet P are removed at line B3-B3 where the belt width becomes narrowest.

It should be understood that the disclosure is not limited to the examples described above and various modifications can be made, and therefore included, within the scope of the disclosure set forth in the claims.

What is claimed is:

1. A medium transporting apparatus, comprising:

an endless conveyor belt having an outer surface to which a medium adheres;

at least two rollers, which are a first roller and a second roller, around which the conveyor belt extends, the second roller being located downstream of the first roller in a medium transporting direction; and a support member that supports an inner surface of the conveyor belt at a position between the first roller and the second roller, wherein the support member includes a hollow-containing portion that is formed at an upstream end of the support member in the medium transporting direction, the hollow-containing portion having a plurality of hollows formed therein in a width direction that intersects the medium transporting direction, the plurality of hollows being formed in a support surface that supports the conveyor belt, wherein each of the hollows is formed so as to taper from an upstream end to a downstream end in the medium transporting direction.

2. The medium transporting apparatus according to claim 1, wherein the plurality of the hollows formed in the support member extends in the medium transporting direction.

3. The medium transporting apparatus according to claim 1, wherein the support surface of the support member is located outside of a tangent that is one of two tangents common to the first roller and the second roller and is closer to the support surface, and the support member is configured to apply tension to the conveyor belt.

4. The medium transporting apparatus according to claim 1, wherein the hollow-containing portion is formed such that the hollows and support portions that support the conveyor belt are disposed alternately in the width direction.

5. The medium transporting apparatus according to claim 4, wherein the hollow-containing portion includes protection portions disposed at least at respective upstream ends of the support portions in the medium transporting direction, and the protection portions protect the conveyor belt that comes into contact with the support portions.

6. The medium transporting apparatus according to claim 4, wherein the support portions are connected to each other in the width direction at the upstream ends of the support portions in the medium transporting direction.

7. The medium transporting apparatus according to claim 1, wherein the hollow-containing portion includes a first region that includes a narrow hollow being narrow in the width direction and a second region that includes a wide hollow being wider than the narrow hollow, and in the hollow-containing portion, the first region is provided at a center in the width direction and the second region is provided at a position closer than the first region to an end in the width direction.

8. The medium transporting apparatus according to claim 1, further comprising a static-eliminating unit that eliminates electric charges from a surface of a medium that is transported by the conveyor belt.

9. The medium transporting apparatus according to claim 8, wherein the static-eliminating unit is disposed at a position opposing the hollow-containing portion.

10. The medium transporting apparatus according to claim 9, further comprising a charging device that is disposed at a position upstream of the static-eliminating unit in a belt rotation direction of the conveyor belt and charges the conveyor belt.

11. The medium transporting apparatus according to claim 10, wherein the conveyor belt is configured such that when the conveyor belt is supported, in the medium transporting direction, by a region of the support member where the hollow-containing portion is disposed, apparent belt width decreases, and the static-eliminating unit eliminates electric charges from a medium transported by the conveyor belt at a position where the belt width is narrowest.

12. The medium transporting apparatus according to claim 1, wherein the conveyor belt is configured such that when the conveyor belt is supported, in the medium transporting direction, by a region of the support member where the hollow-containing portion is disposed, apparent belt width decreases.

13. A recording apparatus, comprising:

a recording head that performs recording onto a medium and the medium transporting apparatus according to claim 1, wherein the conveyor belt supported by the support member opposes the recording head, and the hollow-containing portion is provided upstream of a recording region where the recording head performs recording.

14. A medium transporting apparatus, comprising:

an endless conveyor belt having an outer surface to which a medium adheres;

at least two rollers, which are a first roller and a second roller, around which the conveyor belt extends, the second roller being located downstream of the first roller in a medium transporting direction; and a support member that supports an inner surface of the conveyor belt at a position between the first roller and the second roller, wherein the support member forms, on the conveyor belt, undulations of which a wave direction corresponds to the width direction of the conveyor belt that intersects the medium transporting direction, the undulations being formed at an upstream end of the support member in the medium transporting direction, the undulations being caused by hollows in the support member that are formed so as to taper from an upstream end to a downstream end in the medium transporting direction.

* * * * *